US005121914A

United States Patent [19]

Hargreaves

[11] Patent Number: 5,121,914

[45] Date of Patent: Jun. 16, 1992

[54] APPARATUS FOR CONTROLLING THE SPACING, COUNTING AND BATCHING OF SHEETS FED BY A MACHINE

[76] Inventor: Edward W. Hargreaves, c/o S.E.D. America, 415 Constance Dr., Warminster, Pa. 18974

[21] Appl. No.: 427,864

[22] Filed: Oct. 27, 1989

[51] Int. Cl.[5] ..... B65H 3/06

[52] U.S. Cl. ..... 271/110; 271/265

[58] Field of Search ..... 271/110, 111, 258, 259, 271/265

[56] References Cited

U.S. PATENT DOCUMENTS 3,626,956 12/1971 Sander ..... 271/259 X
4,691,912 9/1987 Gillmann ..... 271/111 X
4,757,984 7/1988 Rowe ..... 271/259 X
4,787,620 11/1988 Goldkuhle ..... 271/111 X

*Primary Examiner*—Richard A. Schacher
*Attorney, Agent, or Firm*—Z. T. Wobensmith, III

[57] ABSTRACT

Apparatus for use ith machines that feed sheets of paper and the like which apparatus controls the machines operation to space, count and batch the sheets being fed.

The apparatus includes an electronic controller which causes the machine to pick sheets one at a time from a stack at timed intervals, feed the sheets onto belts with predetermined spacing count the number of sheets being fed and batch or collect a predetermined number of sheets, which are then delivered fror further processing. The parameters of spacing, counting and batching can be varied as required.

4 Claims, 10 Drawing Sheets

10
11
14
15
16
19
20
21
22
23
25
30
31
32
33
35
38
39
47
48
60
68
69
70
71
72
73
74
76

A = OPMODE
CURRENT SHEET SPACING MODE

YES
0
NO
CALIBRATING
YES
SAVE A TO STACK
NO
INC CALCOUNT
SUCKING
YES
A
A BACK FROM STACK
NO
SPACING
YES
B
NO
NO
BATCHING
YES
DECREMENT OPTIMER
DWELL TIME REMAINING
YES
END OF BATCH
= 0
NO
RTS
D
C

APPARATUS FOR CONTROLLING THE SPACING, COUNTING AND BATCHING OF SHEETS FED BY A MACHINE

BACKGROUND OF THE INVENTION

1. Field of the Invention

This invention relates to apparatus that is intended to monitor and control the operation of machines that feed sheets of paper and the like, which apparatus is of the type that electronically monitors and controls the machine's operations of spacing, counting and batching of the sheets.

2. Description of the Prior Art

The use of counters with various machines that process and or feed sheets of paper and the like, to count the number of sheets being fed is old in the art. Such counters may be either separate from or integrated into the machine.

It is desirable to be able to do more than count the sheets, and apparatus that can be readily attached to existing machines or integrated into new machines for monitoring and controlling machine operation is needed in the industry.

It is desirable to be able to variably space the sheets, to count the number of sheets, to know the number of sheets that have been and are to be fed, to batch the sheets, to be able to change the spacing, count and batch size at will, and to provide a delay between batches so that the batches can be removed for further processing.

The apparatus of the invention electronically provides control of the operations of feeding or processing machines as to sheet spacing, counting and batching of the sheets, and in addition monitors the spacing, counting and batching operations.

SUMMARY OF THE INVENTION

Apparatus for attachment to machines that feed sheets of paper and the like, which apparatus controls and monitors spacing, counting and batching of the sheets being fed or processed.

The principal object of the invention is to provide apparatus for electronically monitoring and controlling the spacing, counting and batching of sheets being fed or processed in a machine.

A further object of the invention is to provide apparatus of the character aforesaid which can be separate from or directly integrated into a machine.

A further object of the invention is to provide apparatus of the character aforesaid whose functions are easy to set or change during operation.

A further object of the invention is to provide apparatus of the character aforesaid which can be used with a wide variety of machines.

A further object of the invention is to provide apparatus of the character aforesaid that is positive and reliable in operation.

A further object of the invention is to provide apparatus of the character aforesaid that provides an accurate read out of the functions that it monitors and controls.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Figure 1:
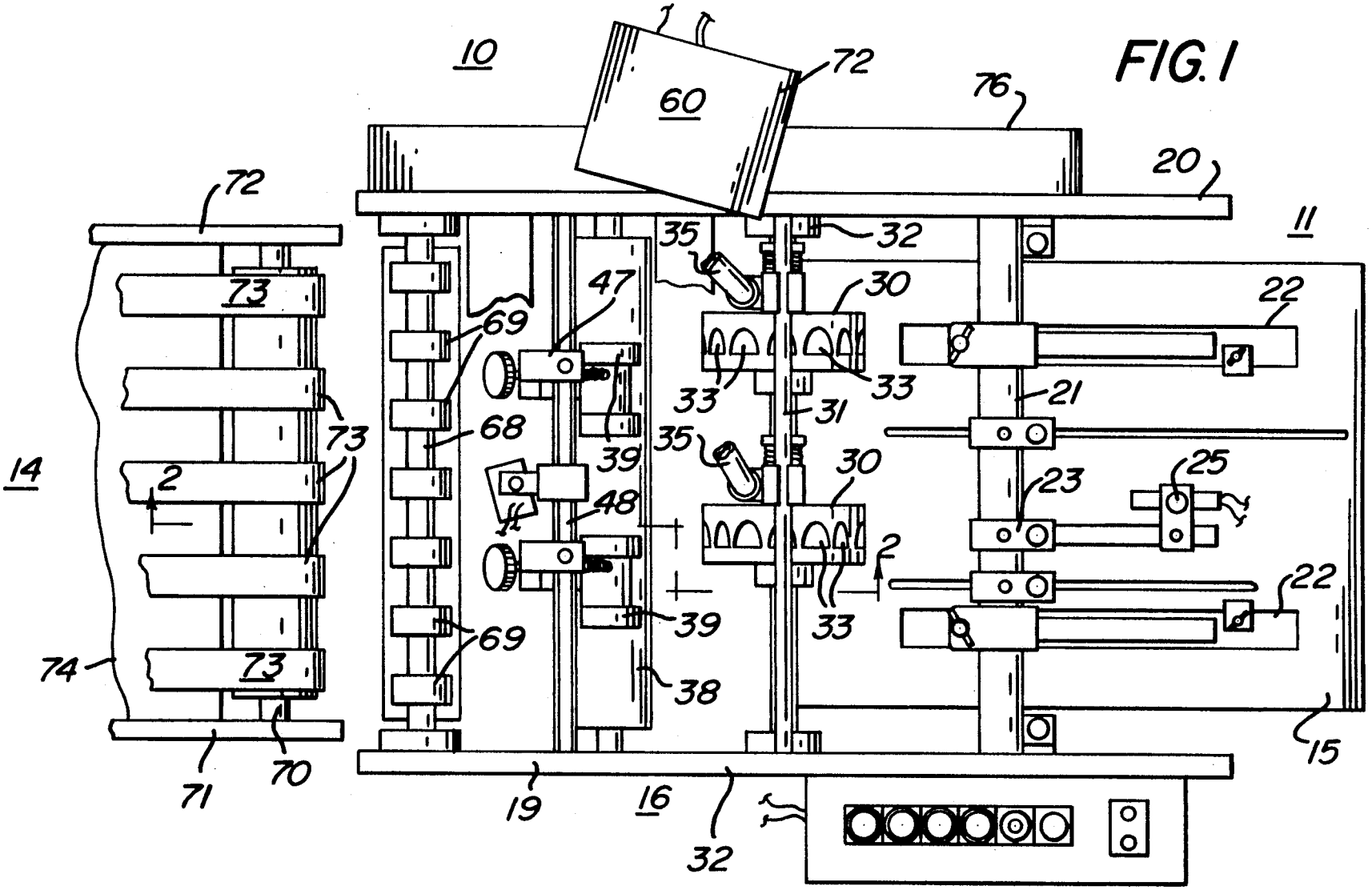
FIG. 1 is a top plan view of a machine for feeding sheets of paper, which incorporates the apparatus of the invention.
Figure 2:
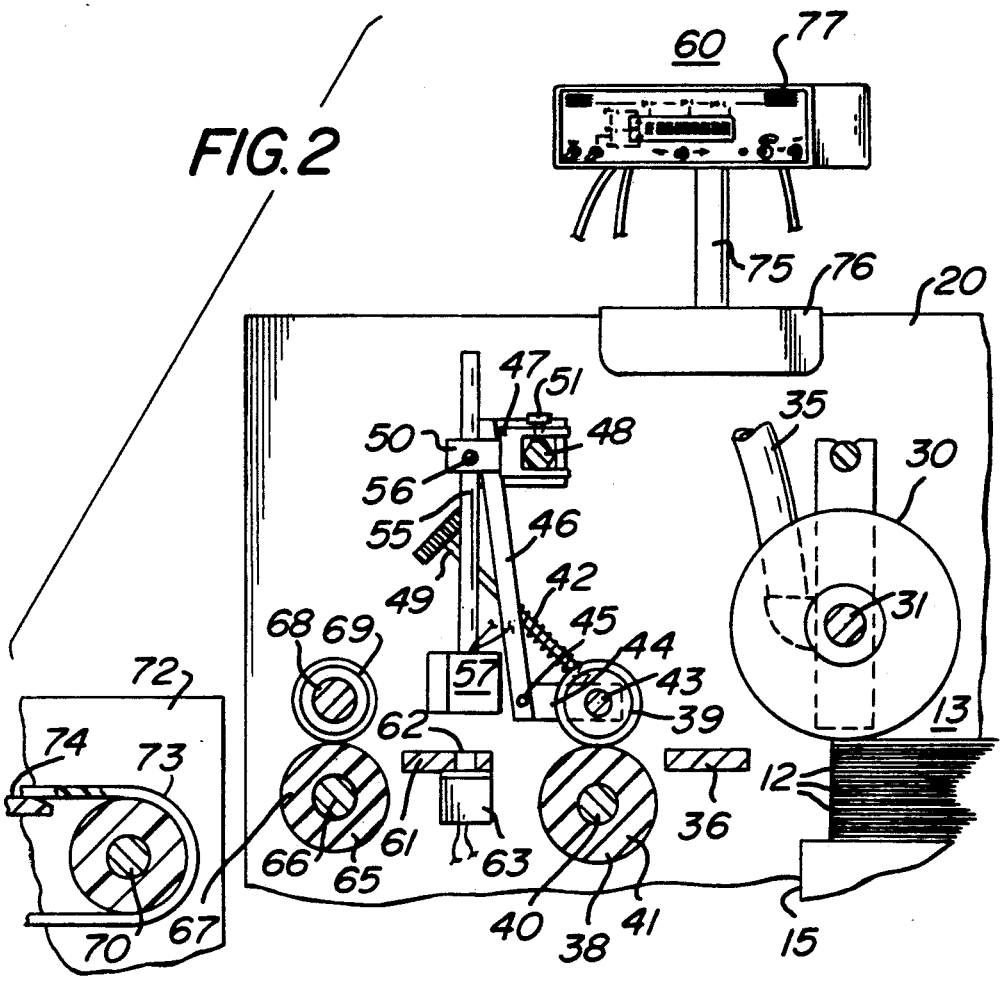
FIG. 2 is a fragmentary vertical sectional view, enlarged, taken approximately on the line 2—2 of FIG. 1.

Referring now more particularly to the drawings and FIGS. 1 and 2 thereof, a portion of a machine 10 for feeding sheets of paper and the like is therein illustrated. The machine 10 as illustrated is typical of machines for feeding sheets of paper which ulitizes vacuum to pick up the sheets of paper, and rollers to transport the sheets to another machine location where they are batched and then delivered for further processing. While the apparatus of the invention is depicted for use with a vacuum operated feeding machine it can be used with other suitable machines as desired. The machine 10 includes a supply section 11 where a stack 13 of sheets of paper 12 are available, and which are to be fed to an intermediate section 16 where they are spaced, counted, measured and then fed to another section 14 where they are accumulated or batched, and when the desired number is obtained, are available for further processing.

The supply section 11 as illustrated can include a vertically movable platform 15 which holds sheets of paper 12 and is urged upwardly by hydraulically actuated cylinders (not shown) of well known type. The machine 10 includes side plates 19 and 20 with the platform 15 between the plates 19 and 20, and with a transverse bar 21 spanning the plates 19 and 20. The bar 21 has a plurality of hold down arms 22 connected thereto which contact the topmost of the sheets 12, and helps to restrain and guide the sheets 12. An additional arm 23 is provided connected to bar 21 which mounts a switch 25, which has a finger (not shown) which contacts the topmost sheet 12 to control the upward movement of the stack of sheets 12.

To the left of platform 15 as seen in FIGS. 1 and 2 a pair of pickoff wheels 30 are provided mounted to shaft 31, journaled in bearings 32 on plates 19 and 20, and driven by a motor (not shown). The wheels 30 are of hollow construction with slots 33 which are in communication with hoses 35, which are connected to a selectively controlled vacuum source (not shown) to be described, for sheet 12 pickoff from stack 13. To the left of wheels 30 a transverse guide plate 36 is provided, spanning side plates 19 and 20, and which receives sheets 12 as they are picked off stack 13 and guides them between rollers 38.

Roller 38 is the bottom roller, has a driven center shaft 40, and an outer resilient covering 41. A pair of dual wheels 39 are provided, each of which is carried by shaft 43 on lower arm 44 and pivotedly attached by pin 45 to arm 46, which is clamped by clamp 47 to a transverse shaft 48 between plates 19 and 20. Clamp 47 is retained on shaft 48 at the desired location by screw 51.

The lower arm 44 has a shaft 49 engaged therewith urged by spring 42, and with arm 46 to control the tension placed by wheels 39 on bottom roller 38.

The clamp 47 has a clamp 50 extending therefrom, with a vertical shaft 55 engaged therewith, and held in position by screw 56. The shaft 55 has a sensor 57 of well known type attached thereto such as an electric eye sensor, attached thereto and which is connected to a monitor and control module 60 to be described. Below the sensor 57, and level with plate 36, another guide plate 61 is provided which has a slot 62 therein, and an electric eye 63 of well known type which is connected to a power source (not shown), provides a beam of light which is received by sensor 57, and which when broken sends a signal to the control module 60. To the left of plate 61 a bottom roller 65 is provided, similar to roller 38, with a driven shaft 66, and a resilient outer covering 67. A shaft 68 is provided above shaft 66, which has a plurality of roller segments 69 thereon, which touch covering 67 to provide a degree of tension to assist sheets 12 to pass between rollers 65 and 69. The accumulation or batching section 14 is to the left of rollers 65 and 69, with roller 70 between side plates 71 and 72 engaged with a plurality of belts 73, which extend over plate 74 to the location (not shown) where the sheets 12 are batched, and from which they are removed for further processing.

Figure 3:
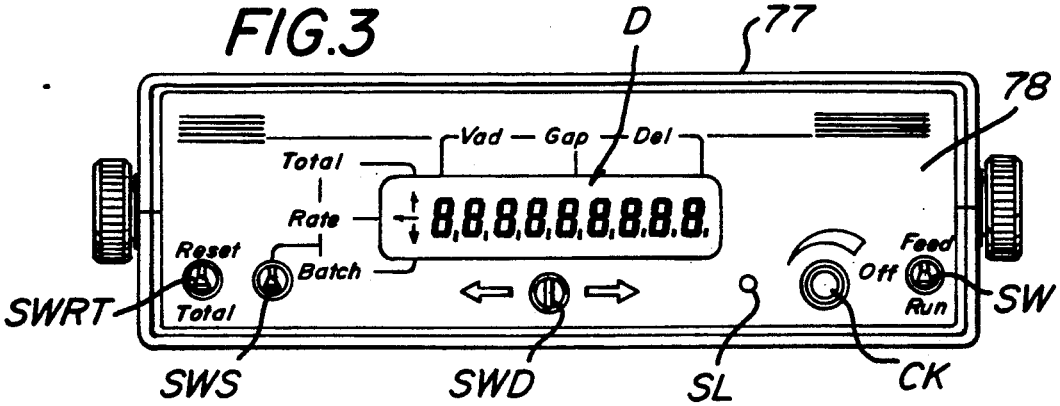
FIG. 3 is a front elevational view of a portion of the apparatus of FIG. 1.

The module 60 is mounted to side plate 20 by shaft 75 on plate 76 which is fastened to the side plate 20. The outer housing, controls and visual indications of module 60 are shown in detail in FIG. 3. The module 60 includes an outer housing 77 with a face 78. The module 60 is illustrated in FIG. 3 from the front, where the functions it performs can be viewed. The module 60 can be the 7000 series batch counter with sheet spacing control available from S.E.D., 14A Maurentania Rd, Nursling Ind. Est. Southampton, England SO19YS. The module 60 on face plate 78 starting from the right in FIG. 3, has a feed-off run switch SW, a control knob CK, a sensor light SL, a digit select switch, SWD, a display D for displaying numbers, a display select switch, SWS, which has positions of total, rate and batch, and with a reset switch SWRT to reset the total count. The display D has locations marked for VAC, GAP, and DEL above display D, to be described. The module 60 may also be provided with additional controls (not shown) such as remote feed switch, internal settings table, end of job switch, gain adjustment, and on/off switch.

The module 60 controls sheet spacing i.e. the relative space between successive sheets, and also controls the time that vacuum is applied to the pick off wheels 30 and to each sheet 12, which can be set initially and varied while the machine 10 is running. Prior to setting sheet spacing the machine 10 must be set for continuous feeding, which is accomplished by rotating control knob CK and pressing digit select switch SWD to the left. Control knob CK is rotated clockwise to increase the value of the VAC display to 9, which shows a flashing digit, then the digit select switch SWD is pressed once to the right. The display will stop flashing, and after four seconds return to the display mode selected by the display select switch SWS. The feed run switch SW is moved down to the run position and the machine 10 is adjusted in well known manner to continuously and reliably feed sheets 10. It should be noted that the count in the continuous mode operation shown by the counter may not be accurate, as the gap between the sheets may be too small to be properly registered.

With the machine 10 operating and feeding satisfactorily the above procedure is used to place the value of 7 in the VAC display. Control knob CK is then rotated to place a flashing digit initial value of 8 in the gap display, and after four seconds the display will return to the mode selected by display switch SWS.

To run the machine 10, press the feed-off-run switch SW up for sufficient time to feed one sheet through the machine. This operation programmes the sheet information into the module 60, and must be performed each time its power has been interrupted, then press the feed-off-run switch SW down to run the machine 10.

The control knob CK is rotated clockwise to increase the gap between successive sheets, and counter clockwise to decrease the gap between successive sheets. The figures shown in the display start from 0 which indicates no gap, and 1 which indicates minimum gap, and can be adjusted to 9 which represents maximum gap. After four seconds the display will return to the selected mode. The gap is not dependent on machine speed, and sheet spacing will therefore remain constant irrespective of changes in the machines' linear speed.

The control module 60 also provides for setting of the vacuum-on time, which must be adjusted to provide for variations in the job being run, so that each sheet 12 being fed has the maximum allowable time required for alignment in the machine.

To set the vacuum on time which is shown in the VAC portion of the display, the control knob CK is rotated and the digit select switch SWD is moved to the left. The control knob CK is rotated clockwise or counter clockwise to set the value of vacuum desired, shown as a flashing number, with 0 representing zero vacuum. The value selected is dependent on the time required for sheet alignment and is obtained by trial and error. After the correct value is determined the digit select switch SWD is moved once to the right. The display digit will stop flashing and after four seconds return to the mode selected by display switch SWS.

The module 60 is also capable of batch counting by providing a delay between batches to enable the batched sheets to be removed to make room for the next batch. The module 60 can provide a display that indicates the number of copies fed from a preset batch quantity, with display-D figure on the left indicating the number of the present batch, and the figure on the right indicating the progress made in completion of the batch quantity.

To set the batch quantity the display select switch SWS is pressed down to the batch position, and the vertical downward arrow on the display D will light. The digit select switch SWD is pressed once to the left. The right hand digit of the left most group will flash.

The batch quantity which can be of any quantity between 2 and 10,000 is inputted by rotation of the control knob CK until the selected value of the flashing digit is obtained. The digit select switch SWD is pressed to the left once, and the remaining digits can be set in turn as described above, to a maximum of four digits. The selection is completed by pressing the digit select switch SWD to the left until the last selected digit stops flashing and any preceeding zeros are cleared. With the display switch SWS in batch position, the batching progress can be determined by pressing the reset switch SWRT upwards and releasing, which will zero the batch progress for counting up, or mirror the batch quantity for counting down. The quantity counting up or down is shown in the right hand side of the display D with the batch quantity set shown at the left of display D.

The module 60 is provided with a delay control to allow time between batches for the completed batch to be removed, and it acts to interrupt the feeder operation of machine 10. The delay when batching is occuring can be set, and for the module 60 the value of the delay is shown under DEL in display D. A value of 0 indicates that batching will not take place, a value of 1 will produce a delay equivalent to the time required to feed three sheets and the maximum value, which is 9, will produce a delay equivalent to 11 sheets. To set the delay time, the control knob CK is rotated one step, and digit select switch SWD is pressed once to the right, control knob CK is rotated clockwise or counter-clockwise to set the desired value for delay, which is shown as a flashing digit. When the desired value has been set, the digit select switch SWD is pressed once to the left, whereupon the display will stop flashing, and after four seconds return to the display mode selected by switch SWS.

The module 60 also provides for changing the direction of the total count or the batch count.

To change the direction of the count the power switch (not shown) on rear of module 60 is set to the off position, and the feed-off-run switch SW is set to the off position. The reset switch SWRT is moved upwardly and held, and the power switch (not shown) is set to the on position. The digit select switch SWD is pressed once to the left and released, the display will now show the software version on the left and the unit serial number on the right. The reset switch SWRT is released and the display D will be blank except for the vertical upward and downward arrow at the left of the display D. The display select switch SWS is set on total or batch, as desired. To change the direction of count the feed-off-run switch SW is lifted and released. The arrow will then indicate the direction of count of total or batch dependent on the position of display select switch SWS. If the reset switch SWRT is actuated and the display select switch SWS is set on total, the display will show the last set count down total, if in count down or '00' if in count up. To change direction of count for batching the display select switch SWS is set to batch and the above procedure followed with batch set to count up, the display at the left hand end will indicate the set batch quantity and at the right hand end the initial display will be zero.

With the batch set to count down, the left hand display will indicate batch quantity, and while the right hand display will initially be the same, it will decrease as the batch is counted down.

The module 60 also provides for inputting a new batch value while the machine 10 is running, and the pre-set batch quantity is counting down. The first batch is inputted as described above and the reset switch SWRT is pressed upwardly. The second batch value is inputted as described above but the reset switch SWRT is not lifted upwardly. The feed-off-run switch SW is moved down to the run position to cause the machine 10 to run, so that upon completion of the first batch the second batch will run.

It is possible to input a thrid batch and so on as desired, and described above for the first and second batches.

The module 60 can also provide the rate of production of the machine 10 in thousands per hour, by pressing the display select switch SWD to the central position, whereby the horizontal arrow will point to rate, and the display D will indicate the instanteous rate of production at the right hand side of display D.

Referring now additionally to FIGS. 4–9 of the drawings, the functions which the module 60 performs in conjunction with monitoring and controlling the operation of the machine 10 are illustrated in diagrammatic form. The module 60 is provided with software to control sheet spacing, which is a part of the software that controls the functions performed by the module. The spacing control software controls the spacing of successive sheets 12 by utilizing the solenoid valve to control vacuum to the pick-off wheels 30, and is used by the machine 10 for batch marking. Provision is made for both the relative space between successive sheets and the time vacuum is applied to each sheet to be set by the operator. Each has a fixed range as a percentage of sheet length.

The sheet spacing counters have a switch which is used to control the machine 10, and as soon as the switch is set to the run position by the operator, the spacing software will be activated. If the operator turns the machine off during a spacing or batching period, the periods will be extended until the switch is set to the RUN position again, when the whole process is restarted. If the operator turns the machine off during a suction (suck) period, the machine is held on until the suck duration has been completed to prevent a sheet being only partially fed. The machine will then remain off until the switch is set to the RUN position, when the whole process will be restarted.

In operation the sheet spacing software is accessed every millisecond from a timer interrupt routine. This software consists of four main operating modes as follows:

1. Calibration: This mode is entered immediately after the leading edge of the sheet 12 being fed is detected by sensor 57. It measures the length of the sheet currently being fed, in time increments of 1 millisecond. This value is used to calculate the working sheet time, from which the suck, space and batch marking dwell durations are calculated.

2. Sucking: This mode controls the duration of the vacuum applied to the pick-off wheels 30 and the sheet being fed. The suck value, calculated from the working sheet time and suck setting, is decremented every millisecond. At the end of the suck period, vacuum is removed and the system enters the spacing mode.

3. Spacing: This mode controls the gap between successive sheets. The space value calculated from the working sheet time and space setting, is decremented every millisecond. The space value includes the duration of the sheet remaining at the end of the suck period, and the actual gap duration required. At the end of the spacing period, a check is made to see if the last sheet fed was the last in the batch. If this is the case then the system enters the batching mode, if not then a new cycle is started with the vacuum applied at the pick-off wheels 30 and the next suck value is ready.

4. Batching: This mode controls the solenoid valve or machine interface used by the machine, and holds the sheet spacing control software off for a time period calculated from the working sheet time and the dwell setting. At the end of the batch mode, a new cycle is started with the vacuum applied at the pick-off wheels 30 and the next suck value is ready.

The following definitions are used in the FIGS. to indicate modes and operations as follows;

OPMODE—currently active sheet spacing mode,

OPTIMER—operation timer; holds suck, space and batch durations;

CALCOUNT—calibrating sheet time;

TEATIME—working sheet time,

SPACE—holds space value set by operator, and

DWELL—holds suck and batch dwell values set by operator

Figure 4:
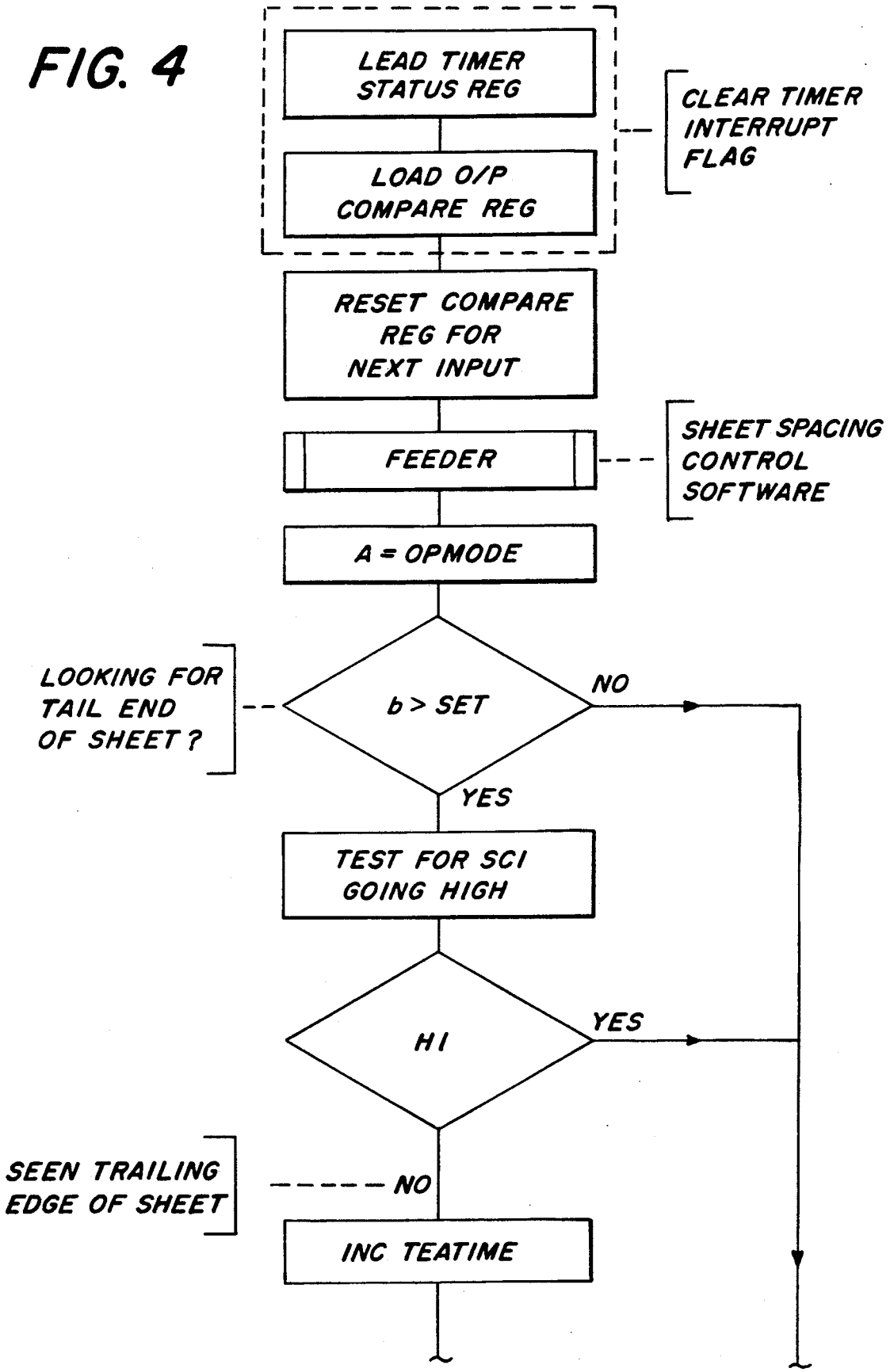
FIG. 4 is a portion of a diagrammatic view depicting the internal steps of operation of the apparatus of FIG. 1.
Figure 4:
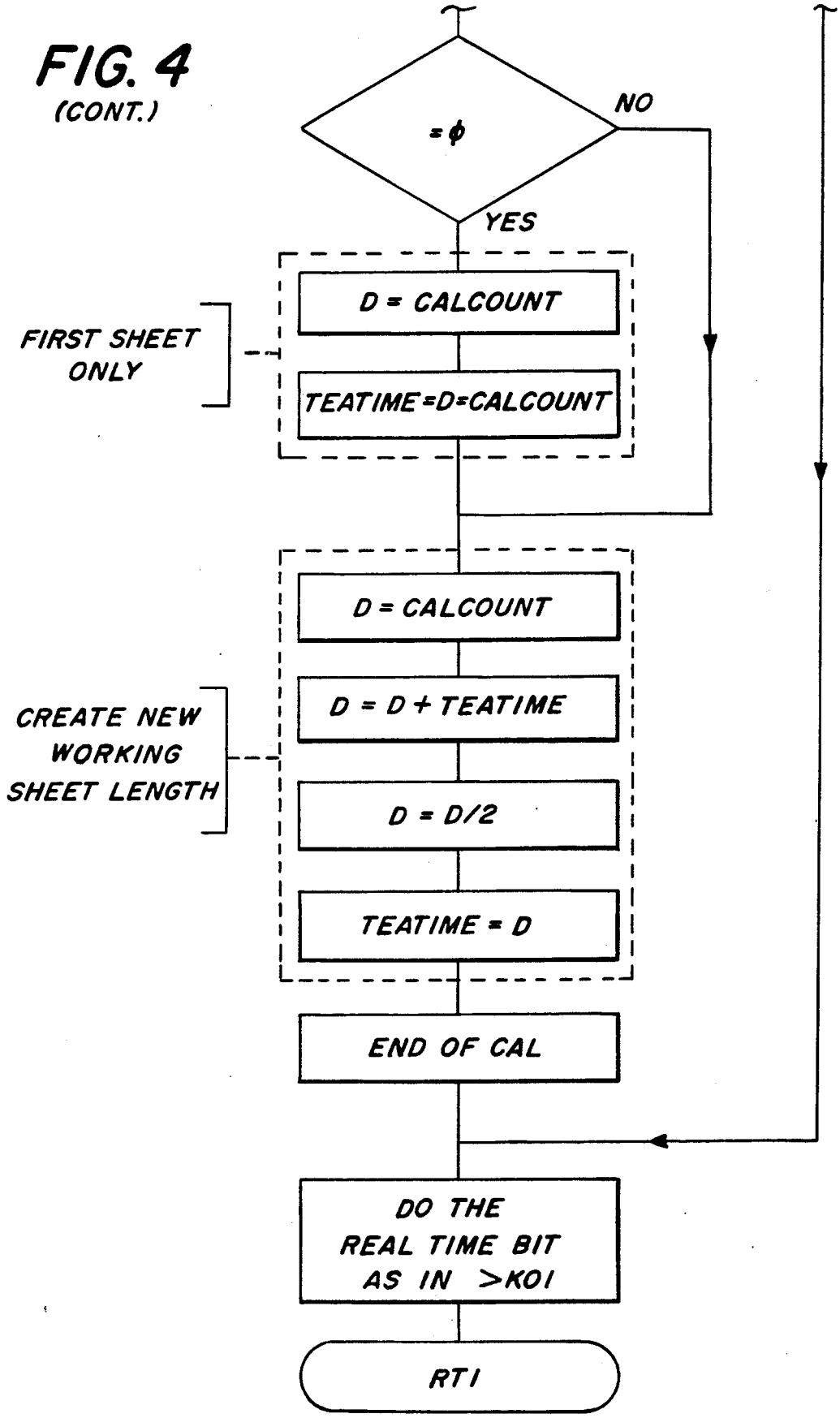

FIG. 4 depicts the functions that are performed by the one millisecond interrupt routine.

Figure 7:
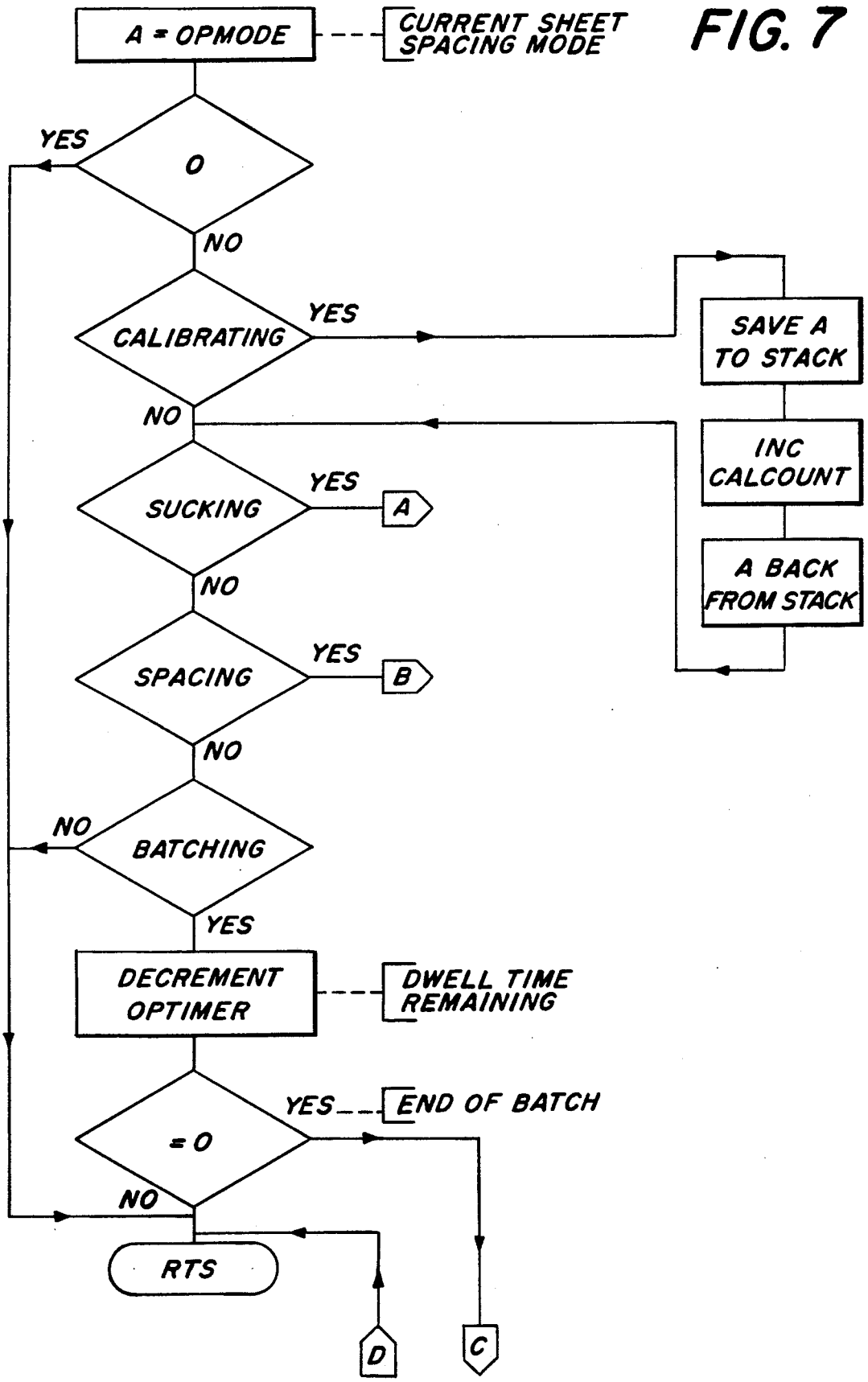
FIG. 7 is a diagrammatic view depicting a portion of the operational steps of the apparatus.
Figure 8:
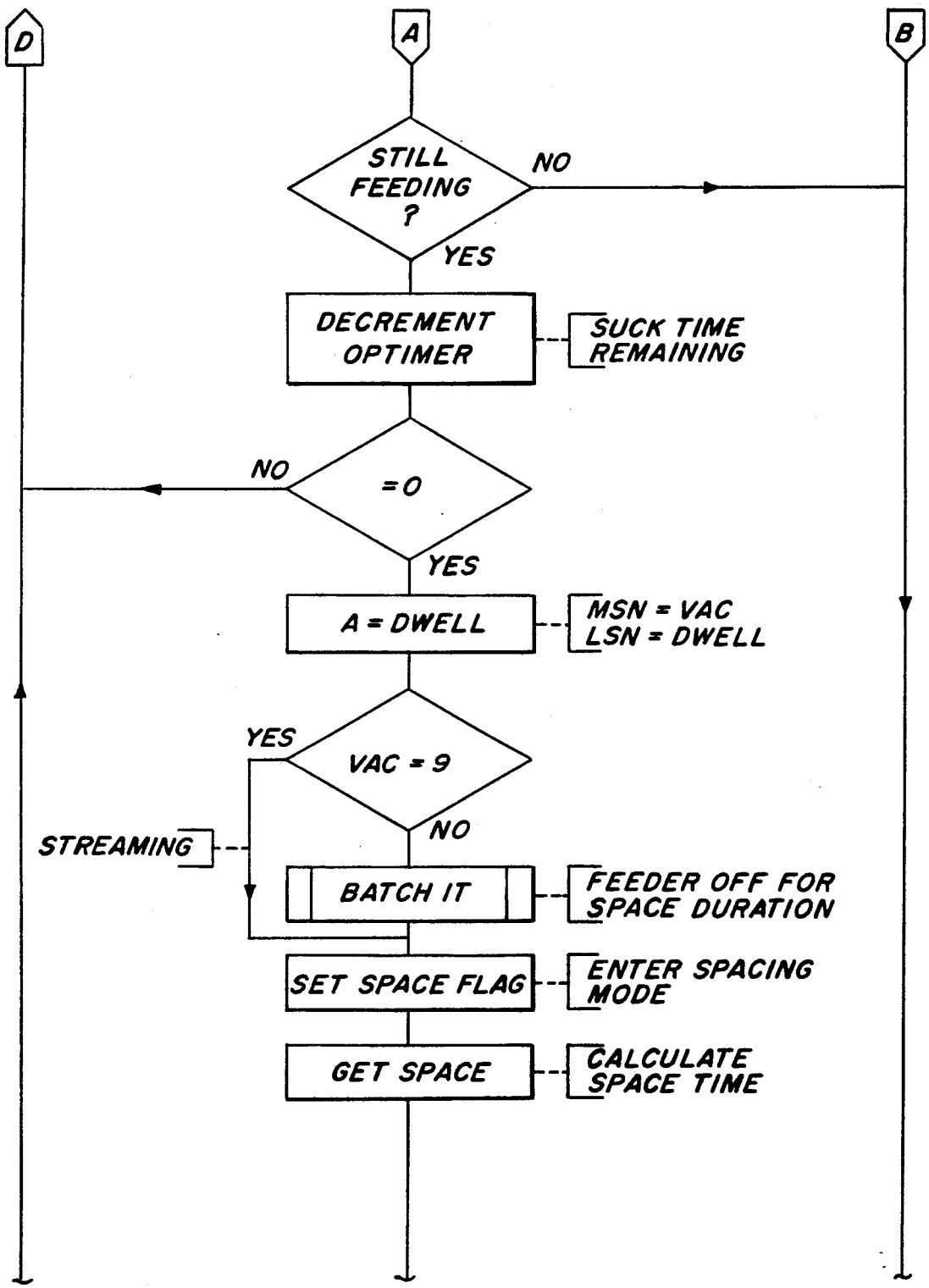
FIG. 8 is a view similar to FIG. 7 depicting further operational steps of the apparatus.
Figure 8:
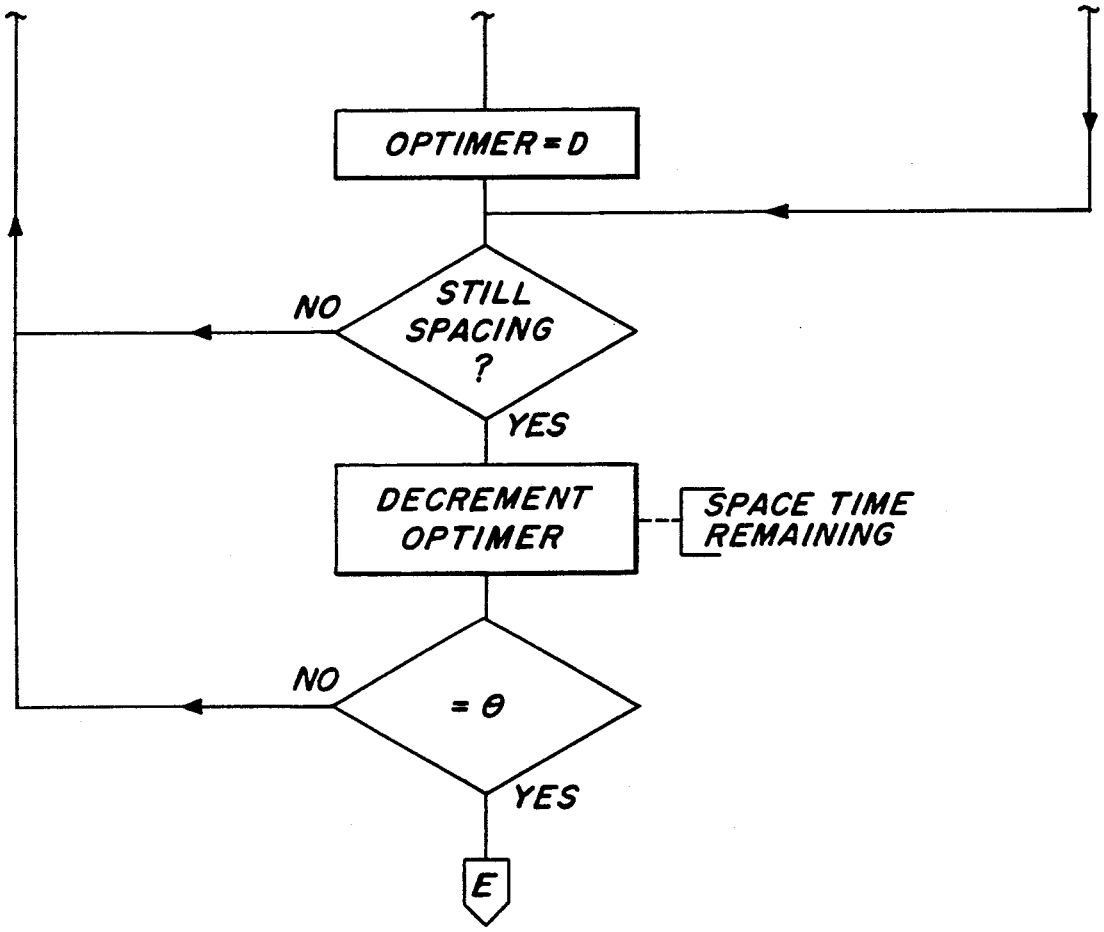
Figure 9:
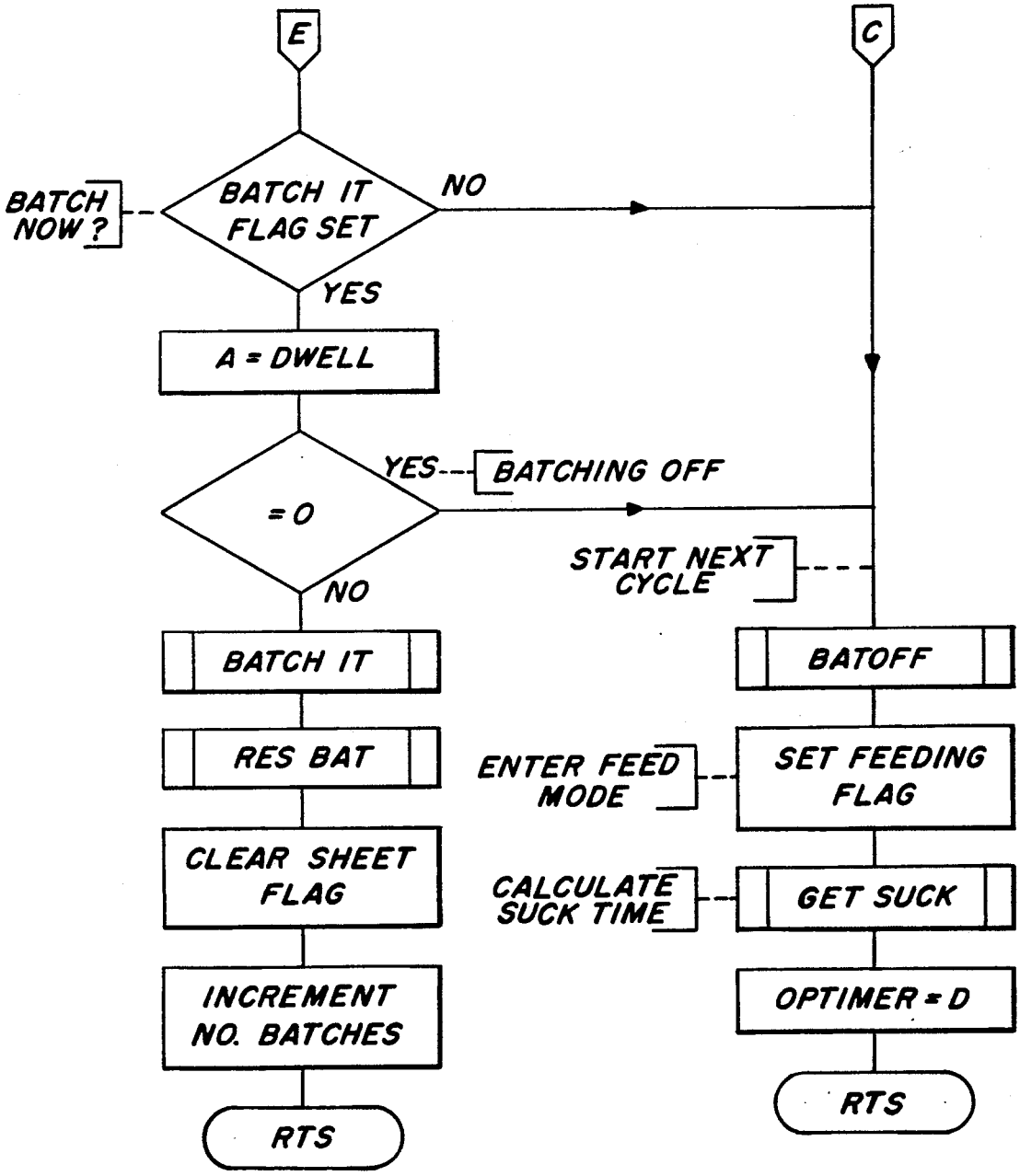
FIG. 9 is a view similar to FIG. 8 depicting still further operational steps of the apparatus.

The main counter operation is interrupted every one millisecond by a microprocessor timer. The routine resets this internal timer ready to count the next one millisecond, then the feeder control sequence is executed, as will be described and as shown in FIGS. 7, 8 and 9.

On completion of the feeder control sequence, the routine checks to see if the feeder sequence is in the calibrating mode. If not, the routine passes into a real time incrementing section before returning to the main counter program. If the feeder control section is in the calibrating mode, the routine checks to see if the tail end of the sheet has been detected. If not, the routine passes into the real time incrementing section. If the tail end of the sheet is detected, then a calculation is performed to generate the new sheet length (TEATIME) on which the feeder control calculations are based.

For each sheet detected the calculation is:

$$TEATIME=(CALCOUNT+TEATIME)/2$$

For the first sheet only the calculation is forced to:

$$TEATIME=(CALCOUNT+CALCOUNT)/2$$

On completing the calculation for the new working sheet length the routine ends the calibrating mode, and passes into the real time incrementing section before returning to the main counter program.

Figure 5:
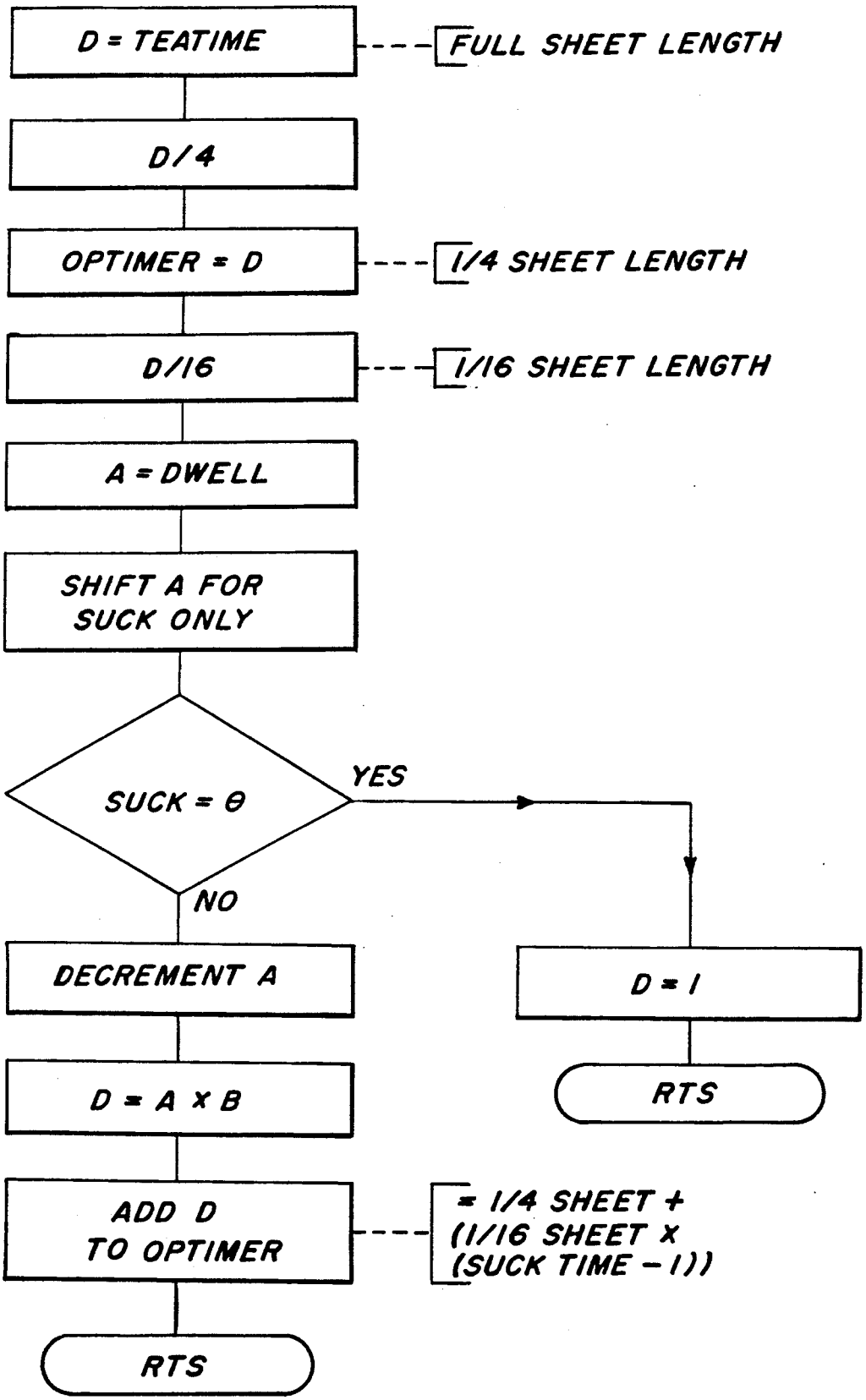
FIG. 5 is a view similar to FIG. 4 depicting operational steps of the apparatus.

FIG. 5 depicts the calculation of the suck duration time.

The calculation is based upon the full working sheet length TEATIME. The resulting duration is in OPTIMER and the formula is $$OPTIMER=\tfrac{1}{4}TEATIME+(1/16\ TEATIME*(SUCK\ TIME-1)$$

This gives a range for suck time of OPTIMER $=\frac{1}{4}$ to $\frac{3}{4}$ TEATIME. For suck=0, OPTIMER is set to 1, which is a duration of only one millisecond. This is the smallest possible value for OPTIMER.

The routine works as follows:

Register D=TEATIME. This is divided by 4 and stored in OPTIMER. D is then divided by 4 again to give a value of TEATIME divided by 16 in D.

Register A is then loaded with the value of suck entered by the operator. If this value is zero, OPTIMER is set to the minimum result of 1 and the routine ends, otherwise the value is decremented by one and multiplied by 8. The result of this mulitplication is then added to OPTIMER to give the total suck duration and the routine ends.

Figure 6:
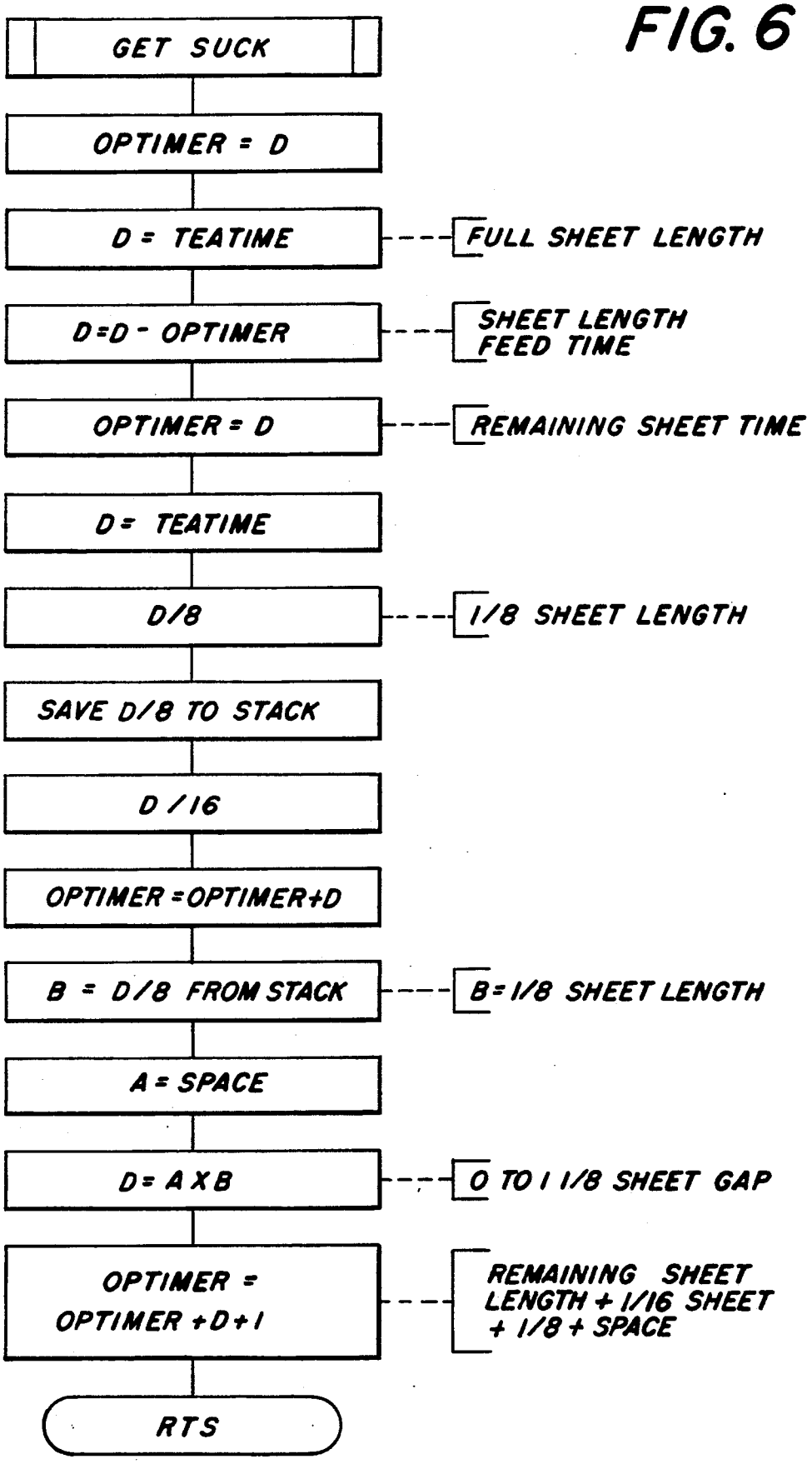
FIG. 6 is a view similar to FIG. 5 depicting operational steps of the apparatus.

FIG. 6 depicts the calculation of the suck duration time.

The calculation is based upon the full working sheet length TEATIME. The resulting duration is in OPTIMER and the formula is $$OPTIMER=REMAINING\ SHEET\ LENGTH\ AFTER\ SUCK+TEATIME/16+(TEATIME/8*SPACE)$$

The routine works as follows:

The suck calculation routine is accessed to find the current suck value. This is stored in OPTIMER.

Register D=TEATIME. The suck time in OPTIMER is subtracted from D to give the sheet time remaining after the suck duration. This result is stored in OPTIMER.

Register D=TEATIME again. D is then divided by 8 and the result saved on the microprocessor's stack. D is then divided further by 2 to give D/16 (TEATIME/16) which is added to OPTIMER.

Register B is then loaded from the microprocessor stack with the D/8 result.

Register A=the value of space set by the operator.

Register D=Register A * Register B. (TEATIME/8 * space)

This result is added to OPTIMER to give the total space duration. 1 is added to this result to prevent a 0 value of OPTIMER being returned and the routine ends.

As for the suck calculation, the smallest possible value for OPTIMER must be 1 millisecond.

FIGS. 7, 8 and 9 depict the operation of the feeder control routine accessed from the one millisecond interrupt routine (FIG. 4).

The routine first checks to find the current feeder control mode. The order of testing for the active mode follows the sequence described below, so that the logical order of machine operation is followed. i.e. SUCKING – SPACING – BATCHING (if required)

If a mode has not been established, then the first sheet has yet to be detected, and the feeder control routine has nothing to work out. In this case the routine passes straight back to the one millisecond routine.

If the program is in calibrating mode, then the count for the new sheet length (CALCOUNT) is incremented by one millisecond. It should be noted that the Calibrating mode can be active during any of the three main operating modes.

If the program is in sucking mode, then vaccum is currently being applied to the pick-off wheels 30. The sucking section of the routine performs the following functions:

Tests if the sucking mode is still active. If not it passes into the spacing section of the routine. If still active, the suck time remaining (OPTIMER) is decremented. If OPTIMER has not reached zero, then the routine exits back to the one millisecond routine.

IF OPTIMER is zero, then the next machine operation should be spacing. The routine checks the vacuum value set by the operator: If set to streaming mode (vacuum=9) then the vacuum is not removed from the pick-off wheels 30, otherwise the vacuum is removed from the pick-off wheels 30, and the routine prepares to pass into the spacing mode. This preparation includes changing the active mode to spacing and calculating the value for the spacing duration, which is put into OPTIMER. The routine then enters the spacing mode.

If the program is in spacing mode, then vacuum is currently removed from the pick-off wheels 30. The spacing section of the feeder control routine performs the following functions:

Tests if the spacing mode is still active. If not it exits back to the one millisecond routine. If still active, the space time remaining (OPTIMER) is decremented. If OPTIMER has not reached zero, then this routine exits back to the one millisecond routine.

If OPTIMER is zero, then the routine tests to see if a batch total has been reached. If not, the routine then prepares to start the cycle again, by turning the vacuum back on, changing the active mode to sucking and calculating the value for the sucking duration, which is put into OPTIMER. The routine then exits to the one millisecond routine. If a batch total has been reached, the routine checks the batch dwell value set by the operator. If this value is zero, then batching is off and the routine prepares to start the next cycle as described above, otherwise the routine prepares to enter the batching mode. This includes changing the active mode to batching, resetting the batch count, clearing the sheet flag so that feeder calculations are not affected by the long intersheet gap of the batch mark, and incrementing a count of the number of batches since the last total reset. The routine then exits to the one millisecond routine.

If the program is in batching mode, this section of the feeder control routine performs the following functions:

Decrements the batch dwell time remaining (OPTIMER). If OPTIMER is not zero the routine exits back to the one millisecond routine, otherwise the routine prepares for the start of a new cycle as described in the spacing section above.

It will thus be seen that the objects of the invention are achieved.

I claim:

1. In combination with a machine that feeds sheets of paper and the like, apparatus for controlling the feeding of said sheets which comprises a control module connected to said machine, said module having means for programming values into said module corresponding to the desired space between successive sheets, said module having means for programming values into said module corresponding to the desired feed on time for successive sheets, said module having means to control the machines feeding of said sheets, a single sensor in said machine to provide signal inputs to said module for each sheet that is fed, said module having means to accumulate said signal inputs from said sensor and to provide visual output values for running and total counts, and said module having means to maintain the programmed space value and feed time from the actual inputted sheet passage time values from said sensor on the machine and to vary the feeding time of said sheets to match the programmed values, which can be applied at any machine speed.

2. Apparatus as defined in claim 1 in which said module has means for interrupting the machines feeding operation to permit accumulated or batched sheets to be removed.

3. Apparatus as defined in claim 1 in which said machine has means for accumulating or batching of said sheets.

4. Apparatus as defined in claim 1 in which said module has means for inputting values whereby successive batches of sheets of different number can be inputted while the apparatus is controlling a batch.

* * * * *